United States Patent [19]

Trigon

[11] 4,216,578

[45] Aug. 12, 1980

[54] METHOD FOR MAKING AN ELECTRIC CABLE WITH IMPROVED TAKEOUTS

[75] Inventor: Jean F. Trigon, Montluel, France

[73] Assignee: Societe l'Electricfil, Lyons, France

[21] Appl. No.: 925,911

[22] Filed: Jul. 19, 1978

[30] Foreign Application Priority Data

Jul. 29, 1977 [FR] France ..... 77 23395

[51] Int. Cl.[2] ..... H01R 43/00

[52] U.S. Cl. ..... 29/857; 339/72

[58] Field of Search ..... 29/630 C, 630 D, 628; 339/59 L, 99, 59 R, 14 R, 121, 223 R; 174/72 R

[56] References Cited

U.S. PATENT DOCUMENTS

| | | | |
|---|---|---|---|
| 1,979,485 | 11/1934 | McPartlin et al. | 339/135 X |
| 1,980,197 | 11/1934 | Gray . | |
| 2,260,121 | 10/1941 | Miller | 339/135 X |
| 2,315,720 | 4/1943 | Mallina et al. | 29/628 |
| 2,845,605 | 7/1958 | Gorman et al. . | |
| 3,153,119 | 10/1964 | Hart | 339/121 |
| 3,248,475 | 4/1966 | Veldhuis | 174/72 R |
| 3,325,765 | 6/1967 | Hart et al. | 339/14 R |

FOREIGN PATENT DOCUMENTS

| | | | |
|---|---|---|---|
| 2421128 | 11/1975 | Fed. Rep. of Germany . | |
| 2245103 | 4/1975 | France . | |
| 933308 | 8/1963 | United Kingdom | 174/72 R |
| 1311067 | 3/1973 | United Kingdom | 174/72 R |
| 1394831 | 5/1975 | United Kingdom . | |

*Primary Examiner*—Carl E. Hall
*Assistant Examiner*—C. J. Arbes
*Attorney, Agent, or Firm*—Michael P. Breston

[57] ABSTRACT

The method for making a takeout, at a junction point on an electric cable covered by a continuous insulating sleeve, involves joining a conductor element at the junction by frictionally inserting the conductor element through a small opening at the selected point in the sleeve. The conductor element makes contact mechanically and electrically with a portion of the electric cable so that the contact surface is covered by the sleeve along the longitudinal direction. The portion of the conductor element extending outside of the electric cable can be bent to provide the desired takeout. Two conductor elements can be so inserted through said opening, in opposite longitudinal directions, and the external portions thereof mechanically and electrically joined together to form the desired takeout. Such electric junction can be improved by twisting and then soldering the external portions of the conductor elements.

3 Claims, 9 Drawing Figures

METHOD FOR MAKING AN ELECTRIC CABLE WITH IMPROVED TAKEOUTS

BACKGROUND OF THE INVENTION (a) Field of the Invention

The present invention relates to the art of electric cables, and more particularly to such electric cables which are insulated by continuous sleeves and which are provided with multiple takeouts therefrom.

A takeout in this art is an electric junction between one or more conductor elements and an electric cable at any desired junction point along its length. In this invention, the electric cable must be covered by an insulating sleeve.

(b) Prior Art

Various methods are known for fabricating electric takeouts from insulated cables. To ensure a practical junction, however, between the conductor element of the takeout and the electric cable, such known methods require either cutting the cable or stripping its insulated sleeve to a considerable extent at the location of the desired junction. Such stripping exposes the bare electric cable to an extent commensurate with the required contact surface between the conductor element and the cable at the junction thereof.

It is the main object of the present invention to provide a novel method for joining a conductor element to an electric cable covered by an insulating sleeve at any point along its length to thereby form an electric takeout.

Such novel method is characterized by the need to make only a relatively small opening in the insulating sleeve at the point of the desired junction, thereby minimizing the extent of exposure of the bare cable at the desired junction point.

SUMMARY OF THE INVENTION

The method for effecting a takeout at a desired junction point on an electric cable, insulated by a continuous sleeve, is characterized by creating in the insulating sleeve at the junction point an opening which exposes the bare cable. The dimensions of such opening are commensurate with the cross-sectional area of the conductor element which is frictionally inserted through such opening under the insulating sleeve along the length of the cable. The conductor element has a contact surface along a predetermined length portion of the cable in the longitudinal direction from the junction point. The contact surface between the conductor element and the bare cable can be easily adjusted without increasing the area of the opening in the sleeve.

This process allows the realization in a very simple fashion (and with appropriate simple tools) multiple takeouts from an electric cable covered by a continuous insulating sleeve.

Preferably, the electric cable is flexed at the level of the opening so as to elastically enlarge the opening, thereby facilitating the frictional insertion of the conductor element or elements under the insulating sleeve and over the conductor cable.

In one embodiment of the invention, the conductor element has a substantially rectangular cross-section. In another embodiment it has a circular cross-section. Its portion outside the electric cable is advantageously bent after the insertion so that it lies in a substantially transverse plane.

Preferably, a second conductor element is inserted in the same fashion through such opening in the sleeve so as to be in frictional engagement between the insulating sleeve and the bare cable but in opposite longitudinal directions. The portions of both conductor elements outside the electric cable are mechanically and electrically joined so as to immobilize the takeout formed by the two conductor elements.

In accordance with a variant of the invention, the outside portions of the pair of conductor elements are twisted. The portions of the conductor elements making frictional contact with the bare electric cable are soldered thereto. Such soldering can advantageously extend as well to the twisted parts of the conductor elements.

After the creation of the takeout, to make the junction between the conductor element or elements and the electric cable waterproof, the opening in the sleeve can be covered with a suitable, flexible and waterproofing material. More elaborately, a waterproof jacket can be molded over the junction to completely cover the electric cable near the junction. In another embodiment, two prefabricated semicylindrical shells can be used to form a waterproof jacket for the junction.

DETAILED DESCRIPTION OF PREFERRED EMBODIMENTS

Figure 1:
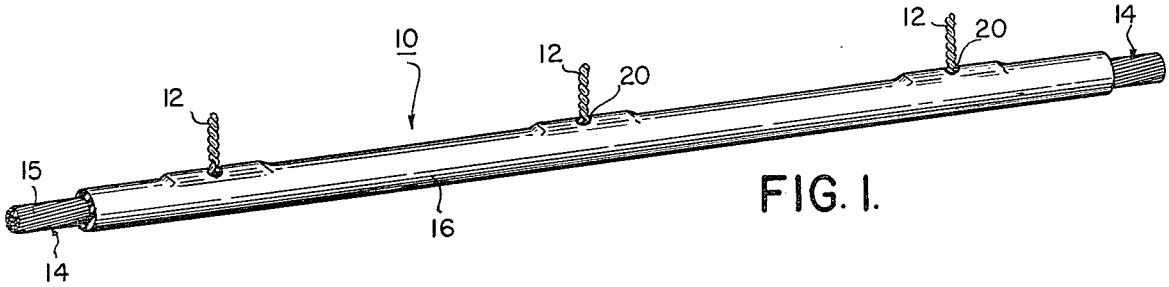
FIG. 1 is a perspective view of an electric cable having a conductor core covered by a continuous insulating sleeve and provided with multiple takeouts.

In FIG. 1 is shown an elongated electric cable, generally designated as 10, which comprises an electric conductor core 14 consisting of a plurality of electric conductors 15. Core 14 is covered by a continuous sleeve 16 made of a suitable flexible insulating material. There are created in sleeve 16 a pluraltiy of openings 20 longitudinally spaced apart at points along cable 10 providing junction points between takeouts 12 and the core 14.

Figure 2:
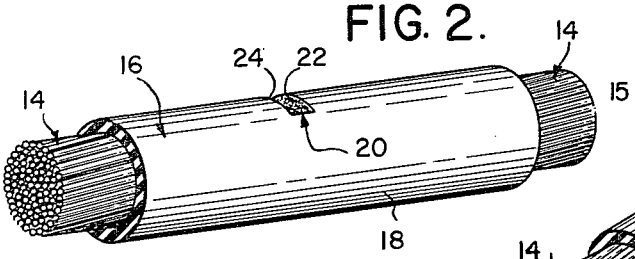
FIG. 2 is an enlarged perspective view of a section of the cable shown in FIG. 1 illustrating the opening in the insulating sleeve.
Figure 3:
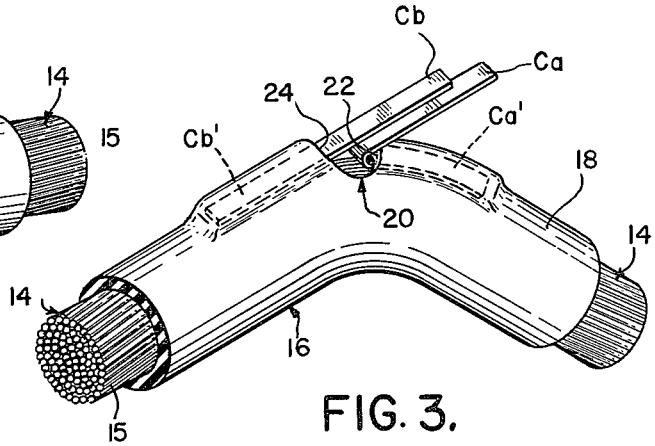
FIG. 3 shows the flexing of the cable at the level of the opening and the insertion through the opening of a pair of conductor elements under the sleeve.
Figure 4:
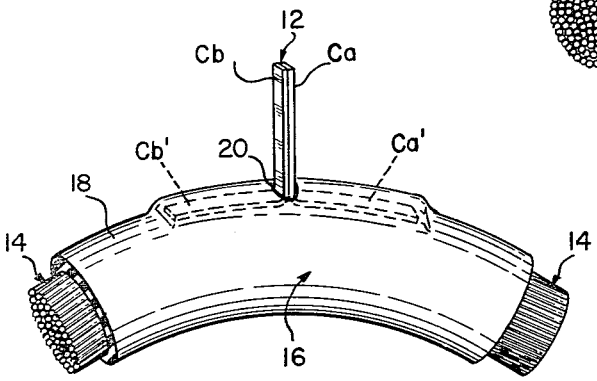
FIG. 4 is similar to FIG. 3 with the portions of the conductor elements external to the cable being bent and joined together mechanically and electrically, thereby completing the creation of the takeout.
Figure 4A:
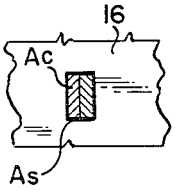
FIG. 4*a* is a detail view showing the cross-sectional area of the takeout conductor elements relative to the area of the opening.

With reference now to FIGS. 2–4, there is shown a section 18 of the electric cable 10 in which the opening 20 created in the sleeve 16 has a cross-sectional area As (FIG. 4*a*). Opening 20 has a pair of opposite edges 22, 24 in the longitudinal direction of sleeve 16.

To facilitate the insertion of a conductor element Ca (FIG. 3) or elements Ca, Cb through the opening 20, the cable section 18 is flexed at the level of the opening so as to increase the spacing between the opposite edges 22, 24 of the opening. The conductor element Ca is inserted through the opening 20 under its edge 22 for a predetermined length along the longitudinal direction of core 14 so that the inner portion Ca′ of the conductor element Ca is frictionally and therefore, mechanically and electrically joined with the bare core 14 under sleeve 16. Then the external portion of the conductor element Ca is bent to an angle greater than 90°, and a second conductor element Cb is inserted through the opening 20 so that a portion thereof Cb′ is frictionally joined to the core 14 but in an opposite longitudinal direction from the portion Ca′ of conductor element Ca.

Thereafter, the external portions of conductor elements Ca, Cb are both bent and joined together to an angle approximately 90 ° relative to the longitudinal axis of cable 10 (FIG. 4). With the external portions of these conductor elements in touching relationship, as shown in FIG. 4, the formation of the takeout 12 is completed and a junction between the conductor elements and the core 14 of cable 10 is formed. The junction is both mechanical and electrical, the mechanical junction being created by friction between the inner portions Ca′ and Cb′ of the conductor elements Ca and Cb, respectively, and the bare core 14.

The cross-sectional area of the formed takeout 12 is Ac (FIG. 4*a*) and, as previously mentioned, the area of the opening is As. Thus it will be appreciated that the area As of the opening 20 need be only large enough to accommodate the cross-sectional area Ac of the takeout 12 and, therefore, the exposure of the bare conductor core 14 can be held to a strict minimum, in accordance with a very important aspect of this invention.

Figure 5:
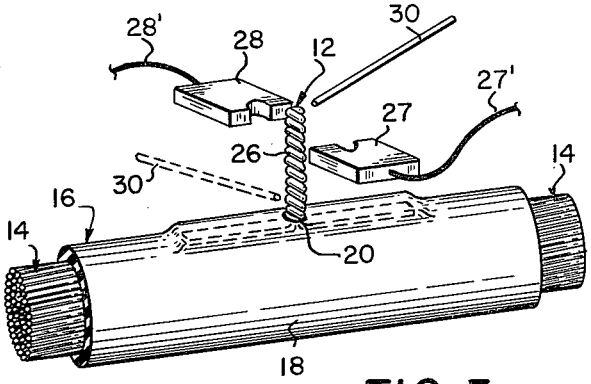
FIG. 5 illustrates a twisted pair of external conductor elements being soldered using a pair of graphite electrodes.

While the cross-sectional areas of the conductor elements Ca, Cb shown in FIGS. 3–4 are rectangular, it will be appreciated that they can be circular, as shown in FIG. 5. The electric junction between the takeout 12 and core 14 can be considerably improved by twisting the external portions of the conductor elements Ca, Cb, and such twisted takeout is designated as 26 in FIG. 5.

The openings 20 in sleeve 16 can be formed by incisions on already formed cable 10 or they can be created during the molding process of the insulating sleeve 16. The cross-sectional area Ac of the joined conductor elements Ca, Cb will depend on the particular application for the takeout. The thickness of each conductor element will depend on the encountered rigidity of the cable at the junction, on the space which can be created between sleeve 16 and core 14, and on the intensity of the current taken out through the particular takeout 12.

In one application, the inner portions Ca′ and Cb′ were inserted to a length of about 3 centimeters, the outer or external ends thereof were twisted and then cut to size.

For certain applications it may be desirable to reinforce the electric and mechanical connections between the conductor elements themselves and between the conductor elements and the core 14 of cable 10. This is especially so when the needed takeout current is appreciable and the takeouts are to be roughly manipulated.

Such reinforcement can be easily accomplished in various ways by soldering. The takeout 12 is preheated by a pair of graphite electrodes 27, 28 (FIG. 5) connected by conductors 27′, 28′, respectively, to a current circuit (not shown). The graphite electrodes have suitable cutouts therein for embracing and more efficiently transferring the heat from the electrodes to the takeout 12. If only the internal portions Ca′, Cb′ are to be soldered to the core 14, the electrodes will be positioned as near to the opening 20 as possible, and a soldering wire 30 (shown in dotted lines) will touch the takeout after it is suitably preheated. Solder will flow by gravity through the opening 20 underneath and around the internal portions Ca′ and Cb′.

It may be also advantageous to solder the external portions of the conductor elements forming the takeout 12, and in that case, the graphite electrodes 27, 28 will be positioned near the outer end of the takeout and the soldering wire 30 (shown in solid lines) will be elevated relative to sleeve 16. In this manner, the entire takeout 12 will be soldered as well as its contact surfaces with core 14.

Figure 5A:
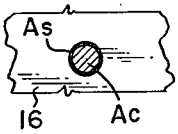
FIG. 5*a* is a detail view showing the cross-sectional area of the twisted takeout pair relative to the area of the openings.

The cross-sectional area of the twisted soldered takeout 26 is again Ac (FIG. 5*a*) and the opening can have a circular area As which is only slightly larger than Ac to accommodate the takeout 26.

While the exposed bareness of conductor core 14 is at a minimum near the junction at opening 20 of the takeout, there may be applications wherein it is desired to completely water-proof the junction so that no liquid can pass through the opening 20 inside of sleeve 16.

Figure 6:
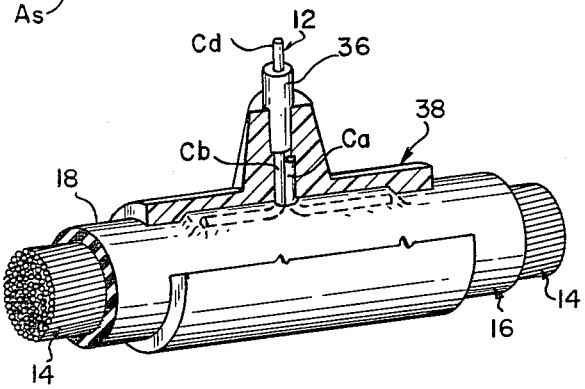
FIG. 6 is a perspective view, partly in section, of a jacket molded over and around the takeout junction making the junction waterproof.

A simple manner of waterproofing the junction at the opening 20 is to apply a waterproofing flexible material around the takeout at the level of the opening 20. On the other hand, it may be desired to provide a more permanent solution as by a molding 38 over the junction. In FIG. 6, the conductor element Cb has an outer extension Cd which is insulated by a sleeve 36, so that the molding 38 will waterproof both sleeves 16 and 36 whereby no water can penetrate into and through the opening 20.

Figure 7:
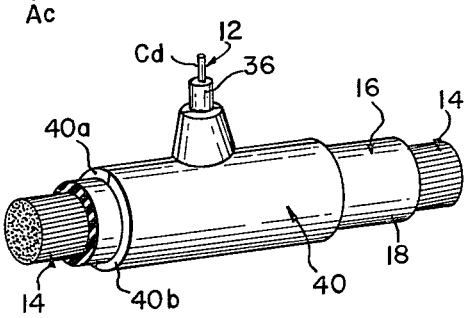
FIG. 7 is a perspective view of a prefabricated waterproofing jacket consisting of two semi-cylindrical sections.

Instead of providing in the factory a molding over the junction, the waterproofing of the takeout can also be accomplished in the field by using two prefabricated semicylindrical complementary shelves **40*a*, 40*b*, which, when placed in position over the sleeves 16 and 36, will form a protective jacket 40, as shown in FIG. 7**.

It will be apparent that it is advantageous for the conductor core 14 to have a certain amount of flexibility so as to facilitate the insertion of the conductor elements Ca, Cb. In the event that the takeout 12 is to be reinforced by soldering as above described, it will be evident that the insulating sleeve 16, which is typically made of an elastomer or of a thermoplastic elastomer, must be capable of resisting the localized heat resulting from the preheating of the takeout 12 by the electrodes 27, 28.

Thus, it will be appreciated that the method of the present invention provides takeouts along an electric cable which are capable of taking out substantial portions of the current carried by the conductor core 14 of cable 10. The effecting of the takeouts can be accomplished at a considerable saving of time and expense when compared to prior art methods for forming takeouts.

Other advantages will readily become apparent to those skilled in the art and it is desired that the scope of the invention be limited only by the claims attached hereto.

I claim:

1. A method of making a takeout at a desired point on an electric cable having a conductor member covered by a continuous insulating sleeve, comprising;

(a) making at said desired point an opening in said insulating sleeve which exposes only a portion of the bare conductor member, with said sleeve remaining otherwise continuous and uninterrupted;

(b) inserting through said opening, between said conductor member and said insulating sleeve, the inner end of a first conductor element so that said inserted inner end (1) is covered by said sleeve, (2) frictionally and electrically engages in touching and non-wrapping relation the electric conductor member, and (3) extends along one longitudinal direction of said conductor member:

(c) inserting through said opening, between said conductor member and said insulating sleeve, the inner end of a second conductor element so that the inserted inner end of said second conductor member (1) is covered by said sleeve, (2) frictionally and electrically engages in touching and non-wrapping relation said electric conductor member, and (3) extends along an opposite longitudinal direction of said conductor member, said opening having an area which is related to the combined cross-sectional areas of said first and second conductor elements; and (d) joining together the outer ends of said first and second conductor elements external of said sleeve to form said takeout.

2. A method of making a takeout at a desired point on an electric cable having a relatively rigid conductor member covered by a continuous insulating sleeve, comprising:

(a) making at said desired point an opening in said insulating sleeve which exposes a portion of the bare conductor member, with said sleeve remaining otherwise continuous and uninterrupted;

(b) inserting through said opening, between said conductor member and said insulating sleeve, the inner end of a first substantially linear and rigid conductor element so that said inserted inner end (1) is covered by said sleeve, (2) frictionally and electrically engages in touching and non-wrapping relation the electric conductor member, and (3) extends along one longitudinal direction of said conductor member;

(c) inserting through said opening, between said conductor member and said insulating sleeve, the inner end of a second substantially linear and rigid conductor element so that the inserted inner end of said second conductor element (1) is covered by said sleeve, (2) frictionally and electrically engages in touching and non-wrapping relation said electric conductor member, and (3) extends along an opposite longitudinal direction of said conductor member, said opening having an area which is related to the combined cross-sectional areas of said first and second conductor elements;

(d) joining together the outer ends of said first and second conductor elements external of said sleeve to form said takeout; and (e) heating said joined outer ends of said conductor elements and simultaneously applying solder to the inner ends of said conductor elements, thereby soldering said inner ends of said conductor elements to said conductor member.

3. A method of making a takeout at a desired point on an electric cable having a relatively rigid conductor member covered by a continuous insulating sleeve, comprising:

(a) making at said desired point an opening in said insulating sleeve which exposes a portion of the bare conductor member, with said sleeve remaining otherwise continouous and uninterrupted;

(b) bending said cable so as to enlarge the area of said opening;

(c) inserting through said opening, between said conductor member and said insulating sleeve, the inner end of a first substantially linear and rigid conductor element so that said inserted inner end (1) is covered by said sleeve, (2) frictionally and electrically engages in touching and non-wrapping relation said conductor member, and (3) extends along one longitudinal direction of said conductor member;

(d) bending the outer end of said first conductor element extending outwardly of said sleeve so that the outer end forms an acute angle with said one longitudinal direction;

(e) inserting through said opening, between said conductor member and said insulating sleeve, the inner end of a second substantially linear and rigid conductor element so that the inserted inner end of said second conductor element (1) is covered by said sleeve, (2) frictionally and electrically engages in touching and non-wrapping relation said conductor member, and (3) extends along an opposite longitudinal direction of said conductor member, said opening having an area which is related to the combined cross-sectional areas of said first and second conductor elements;

(f) joining together the outer ends of said first and second conductor elements external of said sleeve to form said takeout;

(g) heating said joined outer ends of said conductor elements and simultaneously applying solder to the inner ends of said conductor elements, thereby soldering said inner ends of said conductor elements to said conductor member; and (h) covering said opening and said conductor elements with waterproof material to thereby waterproof said takeout.

* * * * *